United States Patent [19]

Cook et al.

[11] Patent Number: 4,753,843

[45] Date of Patent: Jun. 28, 1988

[54] ABSORBENT, PROTECTIVE NONWOVEN FABRIC

[75] Inventors: Ronald F. Cook, Marietta; Monica C. Cunningham, Dunwoody, both of Ga.

[73] Assignee: Kimberly-Clark Corporation, Neenah, Wis.

[21] Appl. No.: 858,329

[22] Filed: May 1, 1986

[51] Int. Cl.[4] ..... B32B 27/00

[52] U.S. Cl. ..... 428/286; 156/167; 427/421; 428/284; 428/297; 428/298; 428/903; 428/913

[58] Field of Search ..... 428/284, 286, 297, 298, 428/903, 913; 156/167; 427/421

[56] References Cited

U.S. PATENT DOCUMENTS

| | | | |
|---|---|---|---|
| 3,916,447 | 11/1975 | Thompson | 2/46 |
| 4,041,203 | 8/1977 | Brock et al. | 428/157 |
| 4,075,382 | 2/1978 | Chapman et al. | 428/192 |
| 4,165,352 | 8/1979 | Volkman | 264/113 |
| 4,196,245 | 4/1980 | Kitson et al. | 428/198 |
| 4,307,143 | 12/1981 | Meitner | 252/91 |
| 4,328,279 | 5/1982 | Meitner et al. | 428/289 |
| 4,379,192 | 4/1983 | Wahlquist | 428/156 |
| 4,426,417 | 1/1984 | Meitner et al. | 428/195 |
| 4,468,428 | 8/1984 | Early et al. | 428/221 |
| 4,508,113 | 4/1985 | Malaney | 128/132 D |
| 4,555,811 | 12/1985 | Shimalla | 2/51 |

*Primary Examiner*—James J. Bell

*Attorney, Agent, or Firm*—William D. Herrick

[57] ABSTRACT

There is disclosed a multi-layered absorbent, protective nonwoven web which has one or more center layers of melt-blown polypropylene microfibers which are naturally hydrophobic. The center layers are sandwiched between one or more melt-blown surface layers on each side which surface layers are composed of melt-blown polypropylene microfibers which have been rendered hydrophilic by addition of a nonionic surfactant during formation of the surface layer microfibers.

12 Claims, 2 Drawing Sheets

ABSORBENT, PROTECTIVE NONWOVEN FABRIC

BACKGROUND OF THE INVENTION

This invention relates generally to nonwoven fabrics and particularly concerns a multi-layered, nonwoven, melt-blown fabric having one or more internal layers that are hydrophobic and are sandwiched between one or more exterior layers which are hydrophilic.

Products made of paper and other low-cost, disposable nonwoven webs have been used for a number of years to protect objects from liquid contact. Familiar examples of such protective products include disposable table napkins, bibs, and tablecloths. Even though such disposable protective products are absorbent, moisture which impinges on one surface may still strike through those conventional absorbent protective products and come in contact with the object to be protected.

Particularly with respect to a table napkin, if water is spilled onto the napkin, it is desirable that the napkin provide two functions. First, the surface of the napkin should absorb the water so that the water does not readily run off the napkin surface. Second, the napkin should provide a barrier between the top surface on which the water impinges and the bottom surface so that the water cannot readily strike through to wet the object below, such as the clothing of the napkin user.

In addition a table napkin or other protective product should function as a wipe that will absorb both aqueous liquid and oils from a surface without streaking or leaving residue.

The preparation of thermoplastic microfiber webs is well known and described, for exmple, in Went, *Industrial and Engineering Chemistry,* Vol. 48, No. 8 (1956) pages 1342 through 1346, as well as in U.S. Pat. Nos. 3,978,185 to Buntin, et al. dated Aug. 31, 1976, 3,795,571 to Prentice dated Mar. 5, 1975, and 3,811,957 to Buntin dated May 21, 1974. These processes generally involve forming a low viscosity thermoplastic polymer melt and extruding filaments into converging air streams which draw the filaments to fine diameters on the average of up to about 10 microns and which break up the filaments into discrete fibers which are then collected to form a nonwoven web.

The Thompson U.S. Pat. No. 3,916,447 discloses a table napkin, or other liquid protective web, which has at least one layer of synthetic polymeric thermoplastic microfibers bonded to at least one layer of cellulosic fibers. In Example 3 of the Thompson patent, a two-ply table napkin is disclosed. The two-ply table napkin is formed by laminating cellulosic tissue (Kleenex single-ply facial grade tissue) and a microfiber web. The tissue has a basis weight of 15.77 grams per square meter. The microfiber web has a basis weight of 15.42 grams per square meter and is formed of melt-blown, naturally hydrophobic, polypropylene fibers having an average fiber diameter in the range of 2 microns to about 6 microns. In Example 5, a disposable handkerchief is disclosed with a tissue laminated to each side of a melt-blown polypropylene web. The tissue layers each have basis weights of 15.77 grams per square meter and the melt-blown web has a basis weight of 7.42 grams per square meter. Consequently, the resulting laminate with the hydrophobic melt-blown polypropylene web is said to have good aqueous liquid barrier properties so that aqueous liquids will not readily strike through the web to the object to be protected.

The Wahlquist et al. U.S. Pat. No. 4,379,192 discloses an absorbent barrier web which is comprised of laminates of fibrous webs and polymeric films. The laminate includes an outer layer of continuous filament spun-bonded material for surface absorption with an inner layer of melt-blown polyolefin microfibers and a backing layer of polymeric film to prevent strike-through. It is suggested that the absorbent capacity of the microfiber polyolefin inner layer may be increased by treating the microfiber mats with a surfactant which may either be sprayed on the microfibers before formation or applied to the surface of the microfiber layer if less absorbent capacity is desired.

The Kitson et al. U.S. Pat. No. 4,196,245 discloses a surgical gown having two internal hydrophobic layers to minimize strike-through. The internal layers are disclosed to be composed of melt-blown polypropylene microfibers. The external layer of the gown may be hydrophobic or hydrophilic and in one embodiment may constitute a spun-bonded rayon web having a basis weight of about 34 grams per square meter which is naturally hydrophilic or which may be treated to be hydrophobic to make the gown liquid repellent.

SUMMARY OF THE INVENTION

It is an object of the present invention to provide a multi-layered, nonwoven, melt-blown web having one or more hydrophilic surface layers on each side of the web and one or more hydrophobic center layers which surface layers and center layers are integrally formed and bonded to each other so that aqueous liquid impinging on one surface of the web is absorbed by the surface layers, does not run off the surface layers, and does not strike through to the opposite surface of the web.

It is a further object of the present invention to provide a nonwoven, melt-blown web having hydrophilic surface layers and hydrophobic center layers which web will absorb oil and aqueous liquid and will be able to wipe surfaces clean of both aqueous liquid and oils without leaving streaks or residue.

In order to realize the objects of the present invention, a multi-layered, nonwoven, melt-blown polyolefin web, preferably composed of polypropylene microfibers, is formed by sequentially depositing and integrally bonding a number of melt-blown layers, one on top of the other, during a single pass through a melt-blown production line having multiple heads or banks. The surface layer or layers on each side of the multi-layered, melt-blown web are treated with a surfactant during formation of the melt-blown microfibers so that the surface on each side of the melt-blown web is rendered hydrophilic and therefore absorbent. The interior layers composed of the melt-blown polypropylene microfibers are not treated with surfactant and are naturally hydrophobic so that aqueous liquid is not absorbed and can therefore not readily strike through the web. Furthermore, the melt-blown polypropylene web with its combination of hydrophilic surface layers and interior hydrophobic layers which are oil absorbent provides an excellent wipe that is capable of absorbing both aqueous liquid and oils in order to clean a surface of both such residue without streaking.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
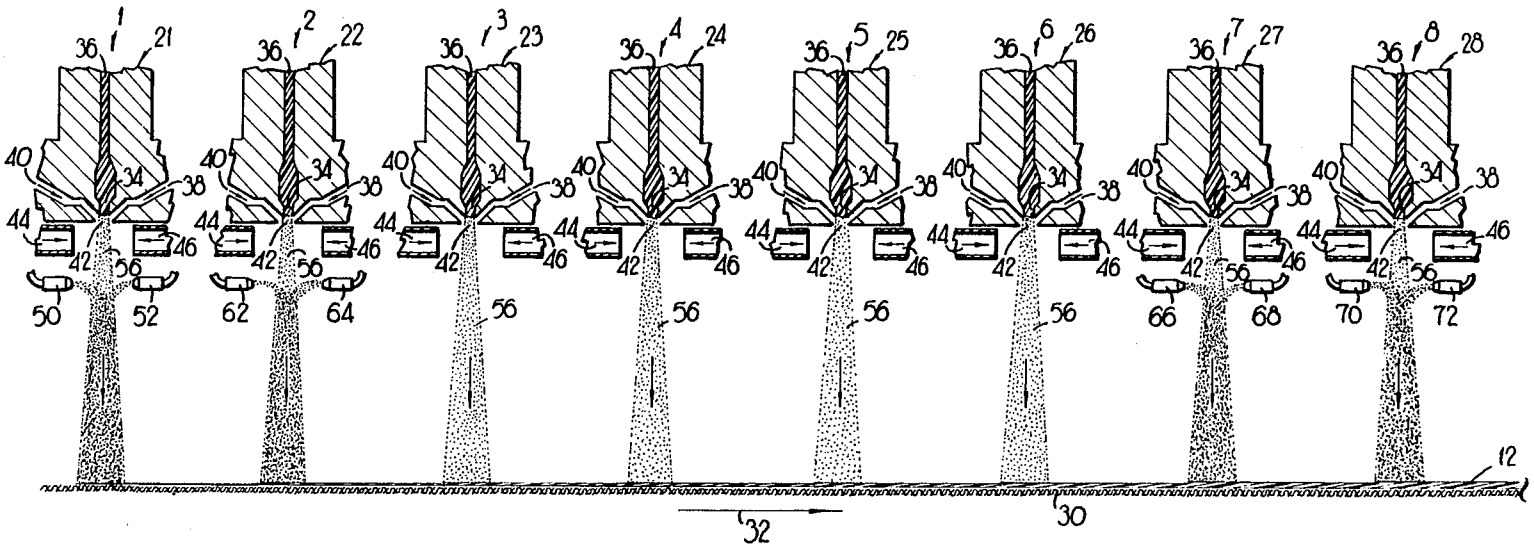
FIG. 1 is a schematic, fragmentary view of an eight-bank melt-blown production line or machine which is used for carrying out the present invention.
Figure 3:
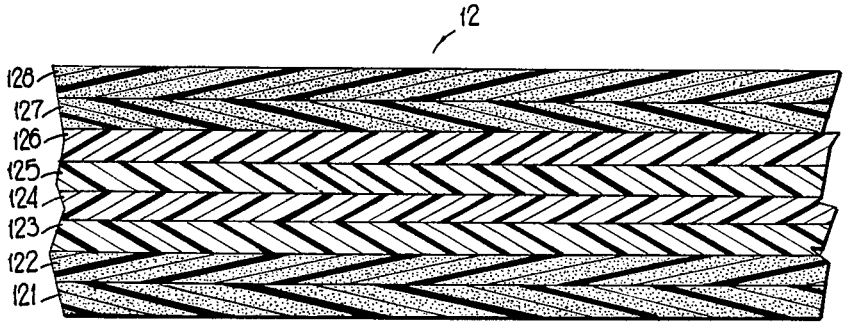
FIG. 3 is a section view, greatly enlarged, of a web which may be converted into the table napkin of FIG. 2.

Turning to FIG. 1, there is shown schematically an eight-bank, melt-blown production line or machine 10 for forming a multi-layered, melt-blown nonwoven web or fabric 12 embodying the present invention. The melt-blown machine 10 is conventional in most respects and includes banks 1–8. Each bank 1–8 includes a die head 21–28 respectively. Each die head 21–18 sequentially deposits a layer of melt-blown polymeric microfibers onto a foraminous belt 30 which is moving in the direction of arrow 32. Consequently, the web 12, as best shown in FIG. 3, is an eight-layered web with layers 121–128 which web is built up layer by layer as the belt moves in the direction indicated by arrow 32 under each of the die heads 21–28.

The first bank 1 will be described in detail. Except as noted, the remaining banks 2–8 are the same. Turning to bank 1, die head 21 is used to produce the first layer 121 (FIG. 3) of the web 12. The die head 21 includes a die orifice 34. A thermoplastic polymer 36, preferably polypropylene, in its melted state is forced by means of a conventional extruder (not shown) through the die orifice 34. Hot fluid, usually air, is supplied on either side of the die orifice via primary air ducts 38 and 40. It is preferred that the die orifice 34 is recessed from opening 42 of the die head 21. Such a recessed die orifice configuration is particularly preferred for die heads 21, 22, 27, and 28 to assure that the outside layers 121, 122, 127, and 128 (FIG. 3) are uniform with the fibers tied down or bonded within those outside layers. Tied down or bonded fibers in the surface layers 121, 122, 127, and 128 improve the abrasion resistance of the web 12. While recessed die orifices are preferred for all die heads 21–28, unrecessed die orifices may be used in die heads 23, 24, 25, and 26 to form the center layers 123, 124, 125, and 126 (FIG. 3) of web 12 where the tie down of fibers is not so critical.

As the polypropylene melt 36 exits the die orifice 34, the high pressure air converging from ducts 38 and 40 attenuates and breaks up the polymer stream to form microfibers 56 which are deposited on the moving foraminous belt 30 to form layer 121 (FIG. 3) of the web 12. A vacuum is drawn by means of an underwire exhaust air flow behind the foraminous belt beneath each die head to draw the fibers onto the belt 30 during the process of melt-blowing. In order to maintain the bulk of web 12, the underwire exhaust is set as low as possible and still retain the web 12 on the belt 30 without flutter.

The die heads 21–28 each have secondary air ducts, such as 44 and 46 for die head 21. The secondary air ducts supply cool air adjacent the die opening 42 at low pressure and velocity in order to quench the molten fibers 56 prior to deposition on the moving foraminous belt.

Banks 1, 2, 7, and 8 relating to the first, second, seventh, and eighth layers 121, 122, 127, and 128 respectively (FIG. 3) of the web 12 include spray nozzles such as nozzles 50 and 52 for bank 1, nozzles 62 and 64 for bank 2, nozzles 66 and 68 for bank 7, and nozzles 70 and 72 for bank 8. The spray nozzles 50 and 52 are used in connection with the present invention to add surfactant to the fibers 56 shortly after formation and prior to deposition on the belt 30. Surfactant is not added to the fibers 56 of the layers formed at banks 3, 4, 5, and 6. Additionally, the surfactant spray assists in quenching the fibers 56. Therefore, the secondary air flow in banks 1, 2, 7, and 8 can be reduced.

The foregoing description of the melt-blown machine 10 is in general conventional and well-known in the art. The characteristics of the melt-blown web 12 can be adjusted by manipulating the various process parameters used in carrying out the melt-blown process on the melt-blowing machine 10. The following parameters can be adjusted and varied in order to change the characteristics of the resulting melt-blown web:

1. Type of polymer;
2. Polymer through-put (pounds per inch of die width per hour—pih);
3. Polymer temperature gradient in extruder (°F.);
4. Extruder pressure (psi);
5. Recessing the die orifice;
6. Primary air flow (standard cubic feet per minute—scfm);
7. Primary air temperature (°F.)
8. Secondary air flow (scfm);
9. Secondary air temperature (°F.)
10. Underwire exhaust (scfm);
11. Distance between the die and the forming belt (inches);
12. Amount of surfactant (gallons per minute of specified concentrate).

Figure 2:
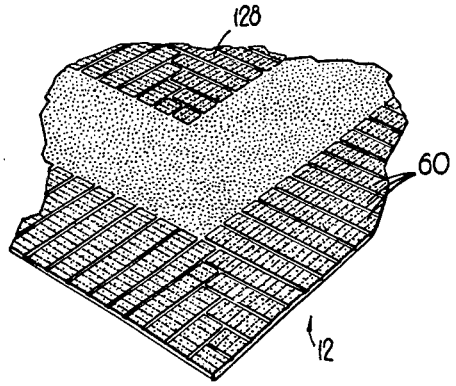
FIG. 2 is a fragmentary, perspective view of the corner of a table napkin embodying the present invention showing the embossing pattern on the surface.

Once the web 12 has been formed by the melt-blowing machine 10, the web is converted to napkins for example, during which conversion the web is embossed in conventional fashion with any desired textural pattern 60 (FIG. 2), cut, and folded.

In order to make the multi-layered, absorbent, protective, nonwoven web or fabric 12 of the present invention, the following processing parameters appear to be significant. First, the polypropylene resin is preferably Exxon 3214 manufactured by Exxon of Des Plaines, Ill. with 2,500 parts per million (ppm) of a prodegradant, such as peroxide, added. An appropriate peroxide prodegradant is BP 1081 manufactured by British Petroleum. Second, the recessed die orifices on die heads 21, 22, 27, and 28 appear to be important because such die heads produce a more uniform layer with generally smaller fibers resulting in the surface fibers being more tied-down into the surface to increase abrasion resistance. Third, a forming distance is selected to reduce the impact of the fibers on the wire and to give the fibers sufficient time to be quenched so that the amount of shot (hard spots) in the layers is reduced. The optimum distance appears to be about twelve inches plus or minus two inches. Fourth, high rates of through-put appear necessary to increase the shear of the polymer during the extrusion. The range of through-put appears to be about 2.5 to 5.5 pih with the preferred level being about 3.2 pih. Fifth, high primary air flow to control lint seems to be advantageous. The primary air flow is about 1,800 scfm plus or minus 200 scfm for a die head having a recessed die orifice and 1,200 scfm plus or minus 200 scfm for a die head having an unrecessed die orifice. Sixth, controlling the temperature gradient in the extruder barrel appears advantageous for controlling the amount of shot and for assuring adequate mixing of the polypropylene resin and the peroxide prodegradant. The extruder barrel has seven zones with the nominal temperatures from zones one to seven as follows: 375° F., 385° F., 395° F., 490° F., 560° F., 560° F., and 560° F. The lower temperatures in the first three zones assure shear and mixing of the polypropylene resin and the peroxide prodegradant while the higher temperatures in the last four zones control the incidence of shot in the final material. The temperatures in the extruder barrel range plus or minus 50° F. Seventh, high extruder pressure is maintained in the barrel to assist in the mixing of polypropylene resin and the peroxide prodegradant. Depending on the carbon build up in the extruder barrel, the extruder pressure is set for 1000 psi plus or minus 500 psi. Eighth, the surfactant add-on for die heads 21, 22, 27, and 28 is a significant parameter. With regard to banks 1 and 8 which produce outside layers 121 and 128, 0.9 gallon per minute of a 1.0% solution of Triton X-102 (octylphenoxypolyethoxyethanol manufactured by Rohm & Haas of Philadelphia, Pa.) is sprayed onto the fibers 56. For banks 2 and 7 which produce layers 122 and 127, 0.35 gallon per minute of a 1.0% solution of Triton X-102 is sprayed onto the fibers 56.

Samples of the absorbent, protective nonwoven web 12 were manufactured using an eight-bank melt-blown production line in accordance with the following process parameters (nominal values) in Example 1 below. The production line had die heads with recessed die orifices on banks 1, 2, 7, and 8 and die heads with standard unrecessed die orifices on banks 3, 4, 5, and 6.

EXAMPLE 1

| | Banks | | | | | | | |
|---|---|---|---|---|---|---|---|---|
| | 1 | 2 | 3 | 4 | 5 | 6 | 7 | 8 |
| Polymer Resin | Exxon 3214 Plus BP 1081 | | | | (all banks) | | | |
| Through-put (pih) | 3.2 | | | | (all banks) | | | |
| Extruder Zone 1 Temp. (°F.) | 375 | | | | (all banks) | | | |
| Extruder Zone 2 Temp. (°F.) | 385 | | | | (all banks) | | | |
| Extruder Zone 3 Temp. (°F.) | 395 | | | | (all banks) | | | |
| Extruder Zone 4 Temp. (°F.) | 490 | | | | (all banks) | | | |
| Extruder Zone 5 Temp. (°F.) | 560 | | | | (all banks) | | | |
| Extruder Zone 6 Temp. (°F.) | 560 | | | | (all banks) | | | |
| Extruder Zone 7 Temp. (°F.) | 560 | | | | (all banks) | | | |
| Extruder Melt Pressure (psi) | 1000 | | | | (all banks) | | | |
| Primary Air Flow ($10^3$) (scfm) | 1.8 | 1.8 | 1.2 | 1.2 | 1.2 | 1.2 | 1.8 | 1.8 |
| Primary Air Temp. (°F.) | 600 | | | | (all banks) | | | |
| Secondary Air Flow ($10^3$) (scfm) | 5–15 | 5–15 | 15–20 | 15–20 | 15–20 | 15–20 | 5–15 | 5–15 |
| Secondary Air Temp. (°F.) | 60–75 | | | | (all banks) | | | |
| Underwire Exhaust ($10^3$) (scfm) | 12–24 | | | | (all banks) | | | |
| Forming Distance (Inches) | 12 | | | | (all banks) | | | |
| Surfactant Add-On (GPM of 1% Sol.) | 0.9 | 0.35 | 0 | 0 | 0 | 0 | 0.35 | 0.9 |

Four samples were manufactured in accordance with the process of Example 1. Each sample was identified by its nominal basis weight —0.75 oz./yd.$^2$, 1.0 oz./yd.$^2$, 1.25 oz./yd.$^2$, and 1.5 oz./yd.$^2$. The basis weight was varied by adjusting the speed of the belt 30. A fifth sample was manufactured by producing two eight-layered, 0.75 oz./yd.$^2$ webs in which the surfactant for banks 7 and 8 was turned off. The two eight-layered, 0.75 oz./yd.$^2$ webs were then laminated together by cold embossing so that the surfactant-treated layers for each fabric were on the outside of the resulting two-ply sixteen-layered, 1.5 oz./yd.$^2$ laminate having twelve hydrophobic center layers sandwiched between two hydrophilic surface layers on each side.

The samples made in accordance with Example 1 had microfibers in layers 121, 122, 127 and 128 ranging in size from approximately 2.0 to 4.0 microns in diameter as a result of using recessed orifices in die heads 21, 22, 27, and 28. The microfibers in layers 123, 124, 125, and 126 ranged in size from approximately 1.5 to 7.5 microns in diameter as a result of using unrecessed die orifices in die heads 23, 24, 25, and 26.

The first four samples had eight layers. The four center layers 123, 124, 125, and 126 were naturally hydrophobic and were sandwiched between surface layers 121 and 122 on one side and surface layers 127 and 128 on the other side which were rendered hydrophilic by the surfactant treatment. Each layer within web 12 was of approximately equal basis weight. Moreover, in the cross machine direction the web 12 was exceptionally uniform in total basis weight varying only 4% to 8% in basis weight across its 120-inch width.

Each of the samples was tested to determine actual basis weight, tensile strength, tear strength, drape stiffness, water capacity, oil capacity, oil rate, oil capillary suction, bulk, and absorbency without penetration. Table I below sets forth the results of the various tests carried out in connection with the five webs manufactured in accordance with the present invention.

TABLE I

| SAMPLE NAME | BASIS WEIGHT oz./yd.$^2$ | BASIS WEIGHT gm./m.$^2$ | GRAB TENSILE DRY (MD) (lb.) | GRAB TENSILE WET (MD) (lb.) | GRAB TENSILE DRY (CD) (lb.) | GRAB TENSILE WET (CD) (lb.) |
|---|---|---|---|---|---|---|
| 0.75 oz./yd.$^2$ | 0.74 | 25.1 | 2.9 | 3.5 | 2.8 | 2.8 |
| 1.0 oz./yd.$^2$ | 1.1 | 37.3 | 4.6 | 5.3 | 4.2 | 4.4 |
| 1.25 oz./yd.$^2$ | 1.2 | 40.7 | 5.9 | 5.8 | 4.9 | 5.1 |
| 1.5 oz./yd.$^2$ ONE PLY | 1.5 | 50.9 | 7.4 | 7.0 | 5.7 | 6.3 |
| 1.5 oz./yd.$^2$ TWO PLY | 1.5 | 50.9 | 6.7 | 3.2 | 6.1 | 3.0 |

| SAMPLE NAME | TRAP. TEAR DRY (MD) (lb.) | TRAP. TEAR WET (MD) (lb.) | TRAP. TEAR DRY (CD) (lb.) | TRAP. TEAR WET (CD) (lb.) | DRAPE STIFFNESS (MD) (cm./gm.) | DRAPE STIFFNESS (CD) (cm./gm.) | CAPACITY WATER (%) |
|---|---|---|---|---|---|---|---|
| 0.75 oz./yd.$^2$ | 1.8 | .8 | 2.3 | 0.6 | 2.0 | 2.1 | 500 |
| 1.0 oz./yd.$^2$ | 1.1 | 1.2 | 1.4 | 1.4 | 2.3 | 2.5 | 770 |
| 1.25 oz./yd.$^2$ | 1.2 | 1.2 | 2.4 | 1.0 | 2.9 | 2.7 | 470 |
| 1.5 oz./yd.$^2$ ONE PLY | 1.4 | 1.6 | 1.1 | 1.2 | 3.0 | 2.5 | 510 |
| 1.5 oz./yd.$^2$ TWO PLY | 1.5 | 1.4 | 1.0 | 1.2 | 3.1 | 2.0 | 330 |

| SAMPLE NAME | CAPACITY OIL (%) | RATE OIL (sec.) | OIL CAP. SUCTION (gm./gm.) | BULK (INCHES) | ABSORBENCY W/OUT PENETRATION TEST % WATER ABSORBED | % WATER PENETRATION | % WATER NOT ABSORBED |
|---|---|---|---|---|---|---|---|
| 0.75 oz./yd.$^2$ | 780 | 26 | 5.50 | .012 | 16 | 38 | 47 |
| 1.0 oz./yd.$^2$ | 780 | 17 | 5.20 | .017 | 18 | 23 | 59 |
| 1.25 oz./yd.$^2$ | 790 | 16 | 5.40 | .018 | 24 | 18 | 58 |
| 1.5 oz./yd.$^2$ ONE PLY | 720 | 14 | 4.50 | .021 | 49 | 10 | 41 |
| 1.5 oz./yd.$^2$ TWO PLY | 720 | 14 | 5.30 | .021 | 11 | 0 | 89 |

Tensile strength was tested using Federal Test Method 191A. Trapezoidal tear strength was tested using ASTM D-1117-14. Drape stiffness was determined in accordance with ASTM D-1388. Water capacity and oil capacity were both determined in accordance with ASTM D-117-5.3. Oil rate was tested in accordance with TAPPI T 432-SM72. Bulk was determined in accordance with Federal Test Method 191A.

Oil capacity suction was obtained essentially as described in Burgeni and Kapur, "Capillary Sorption Equilibria in Fiber Masses", *Textile Research Journal*, May, 1967, pp. 356–356. In that test, a filter funnel was moveably attached to a calibrated vertical post. The funnel was moveable and connected to about 8 inches of capillary glass tubing held in a vertical position. A flat ground 150 ml. Buchner form-fitted glass medium Pyrex filter.disk having a maximum pore diameter in the range of 10–15 microns supported the weighted sample within the funnel. The funnel was filled with Blandol white mineral oil having a specific gravity in the range of 0.845 to 0.860 at 60° F. from Whitco Chemical, Sonneborn Division, and the sample was weighed and placed under 0.4 psi pressure on the filter. After one hour during which the meniscus was maintained constant at a given height of 10 cm., the sample was removed, weighed, and grams (oil) per gram (sample) absorbed calculated.

In addition to the tests described, it is believed that in connection with the present invention the absorbency without penetration of the web 12 is important. In that connection, the following test protocol was established to determine if aqueous liquid impinging upon one surface of web 12 would run off, be absorbed, or strike through. Obviously, optimum performance would result if the material would absorb 100% of the aqueous liquid on the surface with 0% penetrating and 0% running off. The protocol is set forth as follows:

PROCEDURE:

1. Cut blotter to 4.5 inches square.
2. Cut samples to 4 inches square.
3. Accurately weigh the blotter and record the weight.
4. Accurately weigh the sample and record the weight.
5. Place a blotter on the table (on top of a piece of plastic film).
6. Place a sample on top of the blotter (with the absorbent side up if there is a difference between the two sides of the fabric).
7. Take up one ml of water in a syringe.
8. Drop the water from the syringe held about 3 to 4 inches from the surface onto the sample (the water should not be forced from the syringe; it should be dropped lightly onto the material being tested. The drops should be distributed evenly over the sample being tested).
9. Allow the water to absorb into the fabric for one minute.
10. Slowly remove the sample from the blotter and hang up for one minute to allow any excess liquid to run off (shake the sample to remove excess drops, being careful not to get any of the excess water onto the blotter).
11. Reweigh the blotter and record the weight.
12. Reweigh the sample and record the weight.
13. Determine the weight of 1 ml of water (this is done by five consecutive weighings of 1 ml of water dropped from the syringe used for the test).

CALCULATIONS:

Calculate the weight of water absorbed by the material:

A = weight of water absorbed
B = weight of sample dry
C = weight of sample wet $$A=C-B$$

Calculate the weight of the water that penetrated the material:

D=weight of water that penetrated the sample
E=weight of blotter dry
F=weight of blotter wet $$D=F-E$$

Calculate the % water absorbed:

H=% water absorbed
G=the weight of 1 ml of water $$(A/G)\times 100=H$$

Calculate the % water penetration:

I=% water penetration $$(D/G)\text{X}100=I$$

Calculate the % water not absorbed:

J=% water not absorbed $$100-(H+I)=J$$

Returning to Table I, the data therein demonstrates that the 1.0 oz./yd.$^2$, the 1.25 oz./yd.$^2$, and the 1.5 oz./yd.$^2$ one ply sample all provide some degree of protection from strike through and run off. Particularly with the 1.5 oz./yd.$^2$ one ply sample only 10 percent of the liquid strikes through while nearly half is absorbed.

The water and oil capacity test results, oil capillary suction results, and oil rate test results demonstrate the ability of the webs to quickly pick up oil without rubbing and to absorb substantial amounts of both oil and water.

When the 1.0 oz./yd.$^2$ sample web is compared to competitive table napkins, the web of the present invention has advantages of strength and absorbency and over such competitive napkins unless the competitive products have more than 50% greater basis weight as shown in Table II:

TABLE II

| | Sample 1.0 oz./yd.$^2$ | Ft. Howard Preference | Hoffmaster Cellutex | Scott Scottex | Hallmark |
|---|---|---|---|---|---|
| Number of Plys | 1 | 1 | 3 | 2 | 2 |
| Basis Weight oz./yd.$^2$ | 1.0 | 2.0 | 1.6 | 1.0 | 1.6 |
| Ames Bulk (in.) | 0.017 | 0.031 | 0.020 | 0.012 | 0.015 |
| Opacity (%) | 71.3 | 69.5 | 76.7 | 62.5 | 71.8 |
| Grab Tensile | | | | | |
| Dry | | | | | |
| MD | 4.6 | 2.0 | 6.2 | 3.1 | 8.5 |
| CD | 4.2 | 1.4 | 1.4 | 0.5 | 2.0 |
| Wet | | | | | |
| MD | 5.3 | 1.7 | 2.3 | 1.2 | 2.8 |
| CD | 4.4 | 1.3 | 0.7 | 0.2 | 0.6 |
| Water Capacity (gm/m$^2$) | 281 | 585 | 295 | 220 | 270 |
| Oil Capacity (gm/m$^2$) | 287 | 380 | 160 | 120 | 140 |

We claim:

1. An integral nonwoven, melt-blown web comprising one or more surface layers and one or more center layers bonded to each other wherein the center layers consist of discontinuous, thermoplastic fibers formed by melt-blowing, which center layer fibers are hydrophobic and wherein the surface layers consist of discontinuous, thermoplastic fibers formed by melt-blowing, which surface layer fibers are rendered hydrophilic during formation by introducing a surfactant onto the surface layer fibers.

2. The web of claim 1, wherein the center layer fibers and surface layer fibers are produced from a single polymer.

3. The web of claim 2, wherein the polymer is polypropylene.

4. The web of claim 2, wherein the fibers on average range between 1.5 microns and 7.5 microns in diameter.

5. The web of claim 2, wherein the web comprises two surface layers on each side of the web and four center layers and wherein the web has a total basis weight between 0.75 and 1.5 ounces per square yard and all layers have essentially equal basis weights.

6. A method of producing a nonwoven layered web having one or more wettable surface layers and one or more nonwettable center layers, the method comprising:

(a) serially depositing by means of melt-blowing one or more first surface layers of discontinuous, thermoplastic fibers onto a collection surface, wherein a surfactant is added to the first surface layer fibers as the first surface layer fibers are formed to render the surface layers hydrophilic;

(b) serially depositing by means of melt-blowing one or more center layers of discontinuous, thermoplastic fibers on top of the first surface layers, wherein the center layer fibers are naturally hydrophobic; and (c) serially depositing by means of melt-blowing one or more second surface layers of discontinuous, thermoplastic fibers on top of the first center layers, wherein a surfactant is added to the second surface layer fibers as the second surface layer fibers are formed to render the second surface layers hydrophilic.

7. The method of claim 6, wherein the surfactant is a nonionic surfactant and is added to the first and second surface layer fibers by spraying the surfactant onto the fibers after formation and before they are deposited on the collection surface and center layers respectively.

8. The method of claim 7, wherein a 1% solution of the surfactant is added at a rate of between 0.9 and 0.35 gallons per minute.

9. The method of claim 8, wherein the first and second surface layer fibers and the center layer fibers are all produced from a single polymer.

10. The method of claim 9, wherein the polymer is polypropylene.

11. The method of claim 10, wherein the first and second surface layer fibers and the center layers are formed by means of a melt-blowing process having the following process parameters:

(a) a peroxide prodegradant is added to the polypropylene resin.

(b) through-put is between 2.5 and 5.5 pih;

(c) during extrusion through an extruder barrel divided into temperature zones from input to output, temperatures of the polymer is maintained below its melting point for several zones to facilitate mixing of the polymer and peroxide prodegradant in the barrel;

(d) pressure in the extruder barrel is maintained above 500 psi to facilitate mixing of the polymer and peroxide prodegradant;

(e) primary air flow is between 1600 and 2000 scfm;

(f) forming distance is between 10 and 14 inches.

12. A nonwoven web formed by the process of claim 6.

* * * * *

UNITED STATES PATENT AND TRADEMARK OFFICE

CERTIFICATE OF CORRECTION

PATENT NO. : 4,753,843

DATED : 6/28/88

INVENTOR(S) : R. F. Cook, M. C. Cunningham

It is certified that error appears in the above—identified patent and that said Letters Patent is hereby corrected as shown below:

Column 3, Line 28 "21-18" should read --21-28--
Column 7, Line 45 "356-356" should read --356-366--

Signed and Sealed this

Third Day of January, 1989

*Attest:*

DONALD J. QUIGG

*Attesting Officer*

*Commissioner of Patents and Trademarks*